US006773277B2

(12) United States Patent
Issa

(10) Patent No.: US 6,773,277 B2
(45) Date of Patent: Aug. 10, 2004

(54) SECURITY CAP FOR ELECTRICAL PLUGS

(76) Inventor: Antoine Issa, 203-1551 W. 16th Ave., Vancouver (CA), V6J 2L7

( * ) Notice: Subject to any disclaimer, the term of this patent is extended or adjusted under 35 U.S.C. 154(b) by 0 days.

(21) Appl. No.: 10/331,474

(22) Filed: Dec. 31, 2002

(65) Prior Publication Data

US 2004/0127083 A1 Jul. 1, 2004

(51) Int. Cl.[7] ..... H01R 13/44
(52) U.S. Cl. ..... 439/133; 439/304
(58) Field of Search ..... 439/133, 134, 439/304, 149

(56) References Cited

U.S. PATENT DOCUMENTS 2,733,416 A * 1/1956 Evalt ..... 439/134
5,171,155 A * 12/1992 Mendoza ..... 439/134
5,190,466 A * 3/1993 McVey ..... 439/304
5,277,600 A * 1/1994 Meixler ..... 439/134
5,330,361 A * 7/1994 Brend ..... 439/134
5,507,656 A * 4/1996 Ales ..... 439/133
5,848,905 A * 12/1998 Patel ..... 439/134
5,964,598 A * 10/1999 Gonzales ..... 439/133
6,142,797 A * 11/2000 Bailey ..... 439/134
6,508,654 B1 * 1/2003 Tatz ..... 439/134

* cited by examiner

*Primary Examiner*—Tulsidas C. Patel

(57) ABSTRACT

It is common for the prongs of an electrical plug at the end of an electrical cord to be left exposed when not plugged into an electrical receptacle. In the present invention, a locking cap is provided for mounting onto and locking onto the prongs for safety and security. The locking cap when in place deters use of the power tool or other electrical appliance to which the cord is attached, and covers and protects the protruding prongs from damage.

13 Claims, 3 Drawing Sheets

SECURITY CAP FOR ELECTRICAL PLUGS

BACKGROUND OF THE INVENTION

This invention relates to security devices. It is common for the prongs of an electrical plug at the end of an electrical cord to be left exposed when not plugged into an electrical receptacle. There is often nothing to deter an unauthorized user or untrained user, such as a child, from plugging the electrical cord's plug into an electrical receptacle and using the power tool or other electrical appliance to which the cord is attached. It is also common for the exposed prongs to become bent or even broken from being stepped on or from contact with other items in the course of storage or transit.

SUMMARY OF THE INVENTION

A security cap is provided for mounting onto the prongs of an electrical plug for safety and protection of the prongs. The security cap when in place deters use of the power tool or other electrical appliance to which the electrical plug is attached, and covers and protects the protruding prongs from damage.

The security cap for electrical plugs comprises:

a) a lock body adapted to fit over electrical prongs that protrude from the end of an electrical plug;

b) a prong retainer mounted in the lock body, the prong retainer adapted to retain a prong that protrudes from the end of an electrical plug until moved to a prong disengaging position;

c) a release member mounted in the lock body and conditionally moveable against the prong retainer such that sufficient movement of the release member against the prong retainer causes the prong retainer to move to a prong disengaging position;

d) a keyed mechanism mounted in the lock body engaged with the release member such that upon the keyed mechanism being unlocked the release member is sufficiently moveable against the prong retainer to move it to a prong disengaging position.

On typical North American 3-prong polarized plugs, the ground prong is cylindrical with a rounded tip, while the AC current prongs are substantially flat and have holes adjacent to their tips, allowing the prong retainer of the present invention to be effective by having a knob mounted on a flange of the prong retainer, the knob positioned on the flange such that the knob is pressed into a hole on the electrical prong upon the electrical prong being slid into position along the flange.

In a preferred embodiment of the security cap:

a) the release member comprises a release cam, the release member being rotatably mounted on a spine;

b) the keyed mechanism comprises a keyed cylinder than is rotatable within the lock body upon the key releasing the mechanism;

c) the prong retainer comprises a pair of knobs respectively mounted on a pair of flanges, each knob mounted in a position to engage a hole adjacent to the tip of an electrical plug prong that is inserted into the lock body.

Thus a security cap that is mounted on the prongs of an electrical plug can be released by turning the key in the keyed mechanism, which rotates the keyed cylinder, which rotates the release member, such as a cam, which flexes the flanges of the prong retainer outward, thereby removing the knobs from the respective holes adjacent to the tips of the AC current electrical plug prongs.

DETAILED DESCRIPTION

Figure 1:
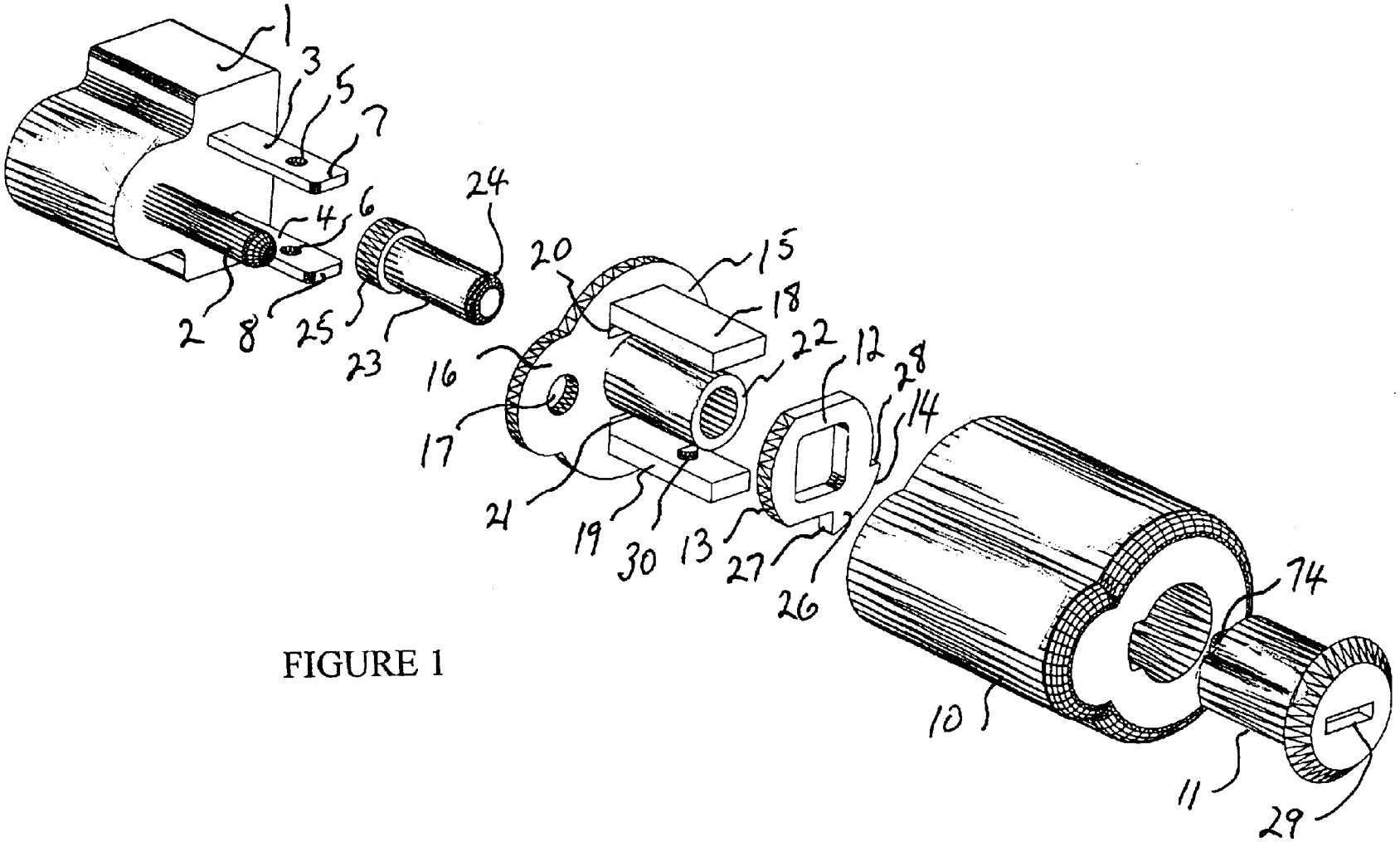
FIG. 1 is an isometric view of an exploded security cap of the present invention, aligned with an electrical plug.

Referring to FIG. 1, a standard 3-prong plug 1 is shown, having a cylindrical ground prong 2 and current prongs 3 and 4 having holes 5 and 6 adjacent to their respective tips 7 and 8. The security cap for electrical plugs comprises a lock body 10, a keyed mechanism 11 with a key slot 29, a release member 12, a prong retainer 15, and a bolt 23 having a bolt head 25 and a threaded end 34 that screws into a spine in the keyed mechanism 11 to hold the parts of the security cap together. The prong retainer 15 has a retainer base 16, in which are mounted prong retainer flanges 18 and 19, and retainer cylinder 22 through which the bolt 23 passes. The electrical plug's ground prong 2 would pass through the ground prong hole 17 in the retainer base 16. The electrical plug's current prongs 3 and 4 would pass through the current prong slots 20 and 21 to abut the prong retainer flanges 18 and 19. As the current prong 4 was being slid along the prong retainer flange 19, the tip 8 would press against knob 30, deflecting prong retainer flange 19 until the knob 30 was pressed into hole 6 on the current prong 4. A like knob on prong retainer flange 18 would fit into hole 5 on the current prong 3. The release member 12 has cam surfaces 13 and 14 to enable the cam member to press against the prong retainer flanges 18 and 19 and deflect them when the release member 12 is rotated between them, thereby removing the knob 30 from the hole 6 on the current prong 4 for detachment of the security cap from the electrical plug.

Still referring to FIG. 1, the release member 12 has a stop flange 26 with sides 27 and 28 that abut current prong 18 or 19 respectively, depending on the position of rotation of the release member. The stop flange 26 thereby constrains the degree of possible rotation of the release member 12, and defines both the lock position and the unlock position of the release member.

Figure 2:
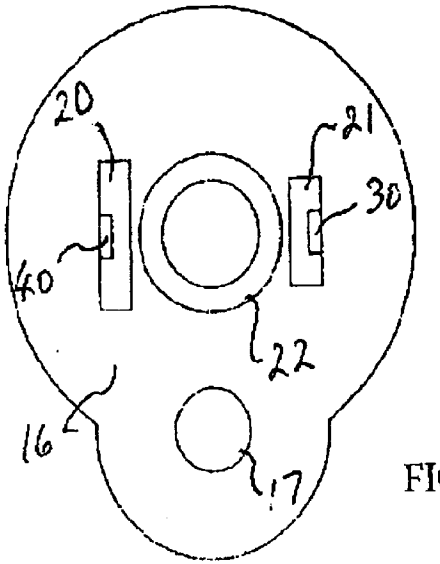
FIG. 2 is an end view of the prong retainer of the security cap.

Referring to FIG. 2, the retainer base 16 has a ground prong hole 17 and current prong slots 20 and 21 on either side of the retainer cylinder 22. Current prong slot 21 is longer than current prong slot 20, to accommodate the wider tip of the corresponding prong in a typical asymmetrically shaped set of current prongs on a polarized electrical plug. The knobs 30 and 40 are shown in the pathway defined by the current prong slots 21 and 20 respectively.

Figure 4:
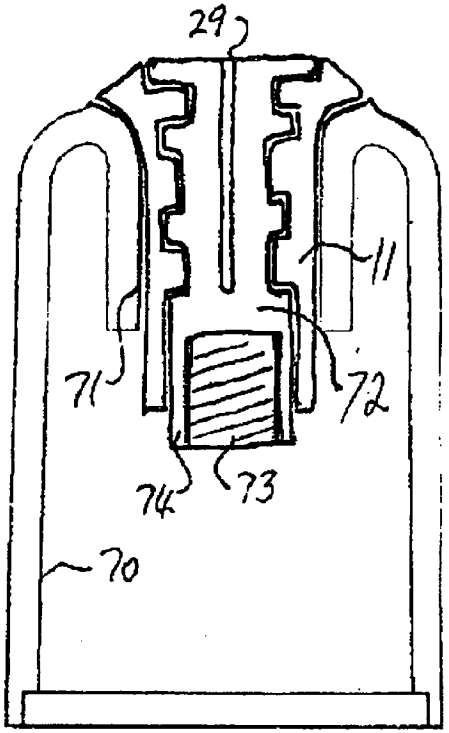
FIG. 4 is the same view as FIG. 3, but with the release member twisted such that the prong retainer flanges are in a prong-releasing position.
Figure 3:
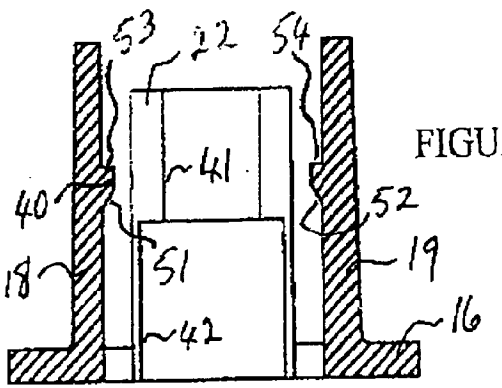
FIG. 3 is a side cross-sectional view of the prong retainer, with the keyed mechanism engaged with the release member inside the lock body, and with the prong retainer flanges in prong gripping position.

Referring to FIGS. 3 and 4, from the retainer base 16 extend perpendicularly prong retainer flanges 18 and 19, having knobs 40 and 30 respectively. The knobs 40 and 30 have angled surfaces 51 and 52 that cause the prong retainer flanges 18 and 19 to deflect when the current prongs are slid along the prong retainer flanges 18 and 19. Once the knobs 40 and 30 are in the holes in the respective current prongs however, stop surfaces 53 and 54 at right angles to the respective prong retainer flanges 18 and 19, prevent the current prong from being withdrawn until the prong retainer flanges are again deflected, this time by means of the release member's rotation. The retainer cylinder 22 has an inner shaft wall 41 to fit the bolt 23 (FIG. 1) and a wider outer shaft wall 42 to contain the bolt head 25 (FIG. 1). The lock body 1 has shaft wall 70 to accommodate the prongs of the electrical plug, and an inner shaft wall 71 to fit the keyed mechanism 11. The spine 72 in the keyed mechanism 11 has a bottom portion 73 that is tapped to receive the threaded end 24 of the bolt 23 (from FIG. 1). The keyed mechanism 11 has a squared engagement end 74 that fits within the release member 12. In FIG. 3 the release member 3 is non-releasing position. In FIG. 4, it has been twisted by the keyed mechanism such that its cam 13 presses the prong retainer flanges 18 and 19 outward to place them in a position in which they would no longer retain the prongs of the electrical plug.

Figure 6:
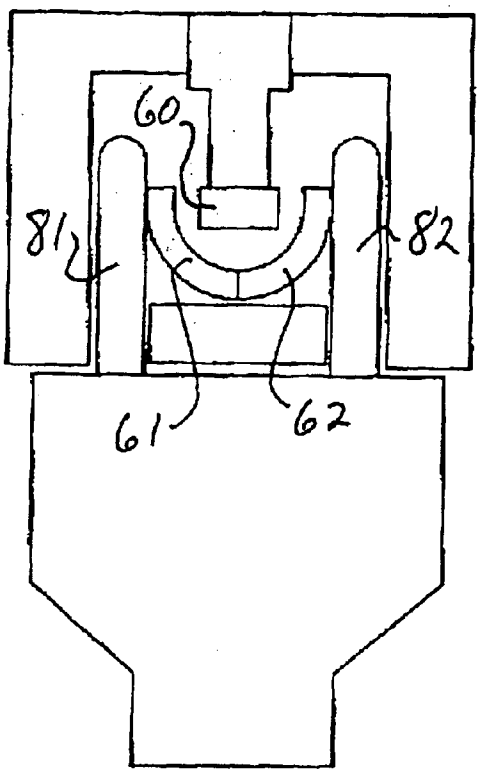
FIGS. 5 and 6 are side views of an alternative prong retainer for round prongs having no hole.
Figure 5:
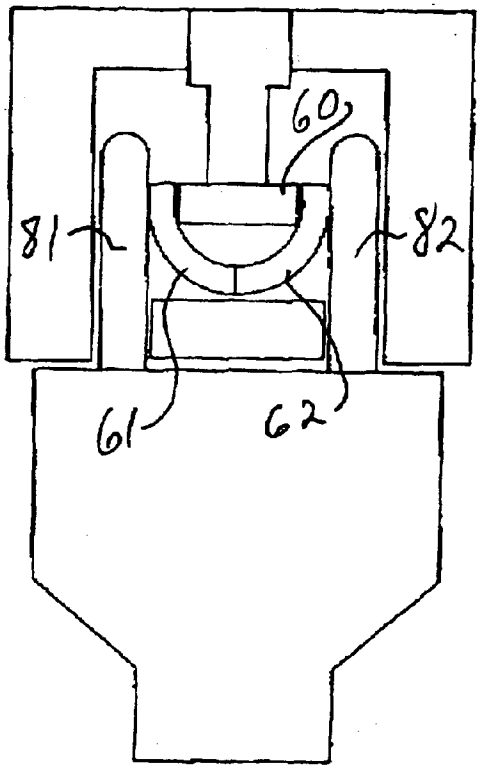

Referring to FIG. 5, the retaining member can alternately comprise a gripping mechanism to retain the current prongs where the current prongs 81 and 82 are cylindrical or have no hole for a retaining knob to engage. The gripping mechanism could comprise a pair of retaining cams 61 and 62 that are compressed against an electrical plug's current prongs by release cam 60 and exert a gripping force on the prongs when a withdrawing force is applied to the electrical plug, unless the keyed mechanism is in a position such that, as shown in FIG. 6, the retaining cam 60 is placed in a disengaging position and allows the gripping cams 61 and 62 to be released from the prongs. The retaining cams can have concave depressions to fit the corresponding contour of a cylindrical electrical prong.

The lock body of the security cap can be shaped substantially like the body of any particular electrical plug that is secured, such that when the cap is mounted on the prongs it is substantially an extension of the plug. This will be aesthetically pleasing and will also will enable equivalent grips of the plug in one hand and the cap in the other during mounting or detachment of the security cap on or from the security cap.

The parts of the security cap could be made from durable plastic or metal or a combination of suitable material. The keyed mechanism could be a stock part, operable with a key, or it could comprise a combination lock.

While certain exemplary embodiments have been described and shown in the accompanying drawings, it is to be understood that such embodiments are merely illustrative of and not restrictive on the broad invention, and that this invention not be limited to the specific construction and arrangements shown and described, since various other modifications may occur to those ordinarily skilled in the art.

I claim:

1. A security cap for electrical plugs, comprising:

a) a lock body adapted to fit over electrical prongs that protrude from the end of an electrical plug b) a prong retainer mounted in the lock body, the prong retainer adapted to retain a prong that protrudes from the end of an electrical plug until moved to a prong disengaging position;

c) a release member mounted in the lock body and conditionally moveable against the prong retainer such that sufficient movement of the release member against the prong retainer causes the prong retainer to move to a prong disengaging position;

d) a keyed mechanism mounted in the lock body engaged with the release member such that upon the keyed mechanism being unlocked the release member is sufficiently moveable against the prong retainer to move it to a prong disengaging position.

2. The security cap for electrical plugs of claim 1, in which the prong retainer comprises at least one knob mounted on a flange, the knob positioned on the flange such that the knob is pressed into a hole on the electrical prong upon the electrical prong being slide along the flange.

3. The security cap for electrical plugs of claim 1, in which the knob comprises an angled surface to enable a current prong of an electrical plug to deflect the flange.

4. The security cap for electrical plugs of claim 1, in which the knob comprises a stop surface perpendicular to the flange, to enable retention of a current prong having a hole into which the knob is inserted until the flange is deflected by a release member.

5. The security cap for electrical plugs of claim 1, in which the release member comprises a release cam, the release member being connecting the release member being rotatably mounted on a spine.

6. The security cap for electrical plugs of claim 1, in which the keyed mechanism comprises a keyed cylinder than is rotatable within the lock body upon the key releasing the mechanism.

7. The security cap for electrical plugs of claim 2, in which the prong retainer comprises a pair of flanges, each such flange mounted in a prong retainer base in a position to abut an electrical plug prong that is inserted into the lock body.

8. The security cap for electrical plugs of claim 7, in which the prong retainer comprises a pair of knobs, each such knob respectively mounted on a flange, in a position to engage a hole adjacent to the end of an electrical plug prong that is inserted into the lock body.

9. The security cap for electrical plugs of claim 1, in which the prong retainer comprises at least one retaining cam that is compressed against an electrical plug prong to exert a gripping force on it when a withdrawing force is applied to the electrical plug, unless the keyed mechanism is in a releasing position.

10. The security cap for electrical plugs of claim 9, in which the prong retainer comprises a pair of such retaining cams.

11. The security cap for electrical plugs of claim 9, in which the retaining cam has concave depressions to fit a rounded contour of a round electrical prong.

12. The security cap for electrical plugs of claim 1, including an electrical plug, the lock body being substantially shaped like a body portion of the electrical plug.

13. The security cap for electrical plugs of claim 2, in which:

a) the knob comprises an angled surface to enable a current prong of an electrical plug to deflect the flange;

b) the knob comprises a stop surface perpendicular to the flange, to enable retention of a current prong having a hole into which the knob is inserted until the flange is deflected by a release member;

c) the release member comprises a release cam, the release member being connecting the release member being rotatably mounted on a spine;

d) the keyed mechanism comprises a keyed cylinder than is rotatable within the lock body upon the key releasing the mechanism;

e) the prong retainer comprises a pair of flanges, each such flange mounted in a prong retainer base in a position to abut an electrical plug prong that is inserted into the lock body;

f) the prong retainer comprises a pair of knobs, each such knob respectively mounted on a flange, in a position to engage a hole adjacent to the end of an electrical plug prong that is inserted into the lock body.

* * * * *